US007010951B2

(12) United States Patent
Wang

(10) Patent No.: US 7,010,951 B2
(45) Date of Patent: Mar. 14, 2006

(54) FEEDING MECHANISM OF AN AUTOMATIC PIPE BENDING MACHINE

(75) Inventor: Sheng-Tsung Wang, Yungkang (TW)

(73) Assignee: Chiao Sheng Machinery Co., Ltd., Tainan Hsien (TW)

( * ) Notice: Subject to any disclaimer, the term of this patent is extended or adjusted under 35 U.S.C. 154(b) by 122 days.

(21) Appl. No.: 10/779,714

(22) Filed: Feb. 18, 2004

(65) Prior Publication Data

US 2005/0178180 A1 Aug. 18, 2005

(51) Int. Cl.
*B21D 7/04* (2006.01)
*B21D 9/05* (2006.01)

(52) U.S. Cl. ..... 72/149; 72/150; 72/151; 72/152; 72/156; 72/157; 72/158; 72/159; 72/307; 72/367.1; 72/387; 72/420; 72/422; 72/453.02

(58) Field of Classification Search ..... 72/149, 72/150, 151, 152, 156, 307, 367.1, 387, 420, 72/422, 453.02
See application file for complete search history.

(56) References Cited

U.S. PATENT DOCUMENTS 4,103,565 A * 8/1978 Matikainen et al. ..... 74/665 L
4,126,030 A * 11/1978 Zollweg et al. ..... 72/154
4,269,054 A * 5/1981 Eaton ..... 72/151
5,142,895 A * 9/1992 Schuchert ..... 72/150
5,259,224 A * 11/1993 Schwarze ..... 72/16.4
5,343,725 A * 9/1994 Sabine ..... 72/155
5,379,624 A * 1/1995 Harman et al. ..... 72/149
5,426,965 A * 6/1995 Hopf ..... 72/149
5,481,891 A * 1/1996 Sabine ..... 72/20.5
5,632,176 A * 5/1997 Bhandari ..... 72/150
5,819,574 A * 10/1998 Yogo ..... 72/155
5,862,697 A * 1/1999 Webster ..... 72/149
6,644,079 B1 * 11/2003 Harman et al. ..... 72/15.4
6,820,450 B1 * 11/2004 Yamada et al. ..... 72/151

* cited by examiner

*Primary Examiner*—Derris H. Banks
*Assistant Examiner*—Hung C. Le
(74) *Attorney, Agent, or Firm*—Rosenberg, Klein & Lee

(57) ABSTRACT

A feeding mechanism of a pipe bending machine is equipped with several auxiliary hydraulic cylinders in addition to an original power source for providing power to feed a pipe; the auxiliary hydraulic cylinders are joined to an auxiliary fixing member at output rods thereof, which fixing member is displaceable along a toothed locating rod secured on the bending machine, and is equipped with an engaging device capable of releaseably engaging the toothed locating rod to fix the fixing member in position; thus, the feeding mechanism can feed a pipe with increased force output when the fixing member is made unmovable along the locating rod by the engaging device, and when the auxiliary hydraulic cylinders operate.

5 Claims, 12 Drawing Sheets

FEEDING MECHANISM OF AN AUTOMATIC PIPE BENDING MACHINE

BACKGROUND OF THE INVENTION

1. Field of the Invention

The present invention relates to a feeding mechanism of an automatic pipe bending machine, more particularly one, which is equipped with two additional hydraulic cylinders, and an auxiliary fixing member capable of releaseably engaging a secured toothed locating rod plus connected with output rods of the additional hydraulic cylinders; thus, the feeding mechanism can feed a pipe with increased force output when the auxiliary fixing member is engaged with the locating rod, and when the additional hydraulic cylinders operate.

2. Brief Description of the Prior Art

Referring to FIGS. 10 to 13, a conventional automatic pipe bending machine 5 includes a main body 51, a feeding mechanism 52, and a bending mechanism comprised of both a fixed mold part 53 and a movable mold part 54.

Parallel guide rail 511 and rack 512 are secured on the main body 51. The feeding mechanism 52 is displaceable along the guide rail 511, and includes a first power source 521, a second power source 522, a holding tube 523 connected to the first power source 521, a transmission 524 connected to the second power source 522, and a gear 525 secured to an output shaft of the transmission 524 as well as engaged with the rack 512. To bend a pipe with the bending machine, the pipe is first secured to the holding tube 523, and the first and the second power sources 521 and 522 are actuated to make the holding tube 523 rotate, and the gear 525 roll along the rack 512 respectively. Thus, the feeding mechanism 52 is moved forwards, and in turns, the pipe is fed into the bending mechanism, and at the same time rotated together with the holding tube 523. Finally, the pipe is secured to the mold parts 53 and 54, and bent into a desired shape by means of angularly displacing the movable mold part 54 outwards.

Because the power source 522 makes the whole feeding mechanism 52 move forwards to feed a pipe with the help of the gear 525 and the rack 512 only, a lot of force will be exerted on the gear 525 and the rack 512 when the bending machine is in operation. Consequently, the gear 525 and the rack 512 are prone to wear, and the bending machine can't operate smoothly.

SUMMARY OF THE INVENTION

It is a main object of the present invention to provide a feeding mechanism of an automatic pipe bending machine to overcome the above disadvantages.

The feeding mechanism of the present invention is equipped with several auxiliary hydraulic cylinders in addition to an original power source for providing power to feed a pipe. The auxiliary hydraulic cylinders are joined to an auxiliary fixing member at output rods thereof, which fixing member is displaceable along a toothed locating rod secured on a main body of the bending machine, and has an engaging device fitted thereto. The engaging device can releaseably engage the toothed locating rod to fix the fixing member in position; thus, the feeding mechanism can feed a pipe with increased force output when the fixing member is secured to the locating rod by the engaging device, and when the auxiliary hydraulic cylinders operate. Therefore, original transmission gears and racks, which are connected to the original power source, won't be subjected too much force, because total force output of the feeding mechanism is only partly exerted on them. And, a pipe can be fed more smoothly with the help of the auxiliary hydraulic cylinders.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 8:
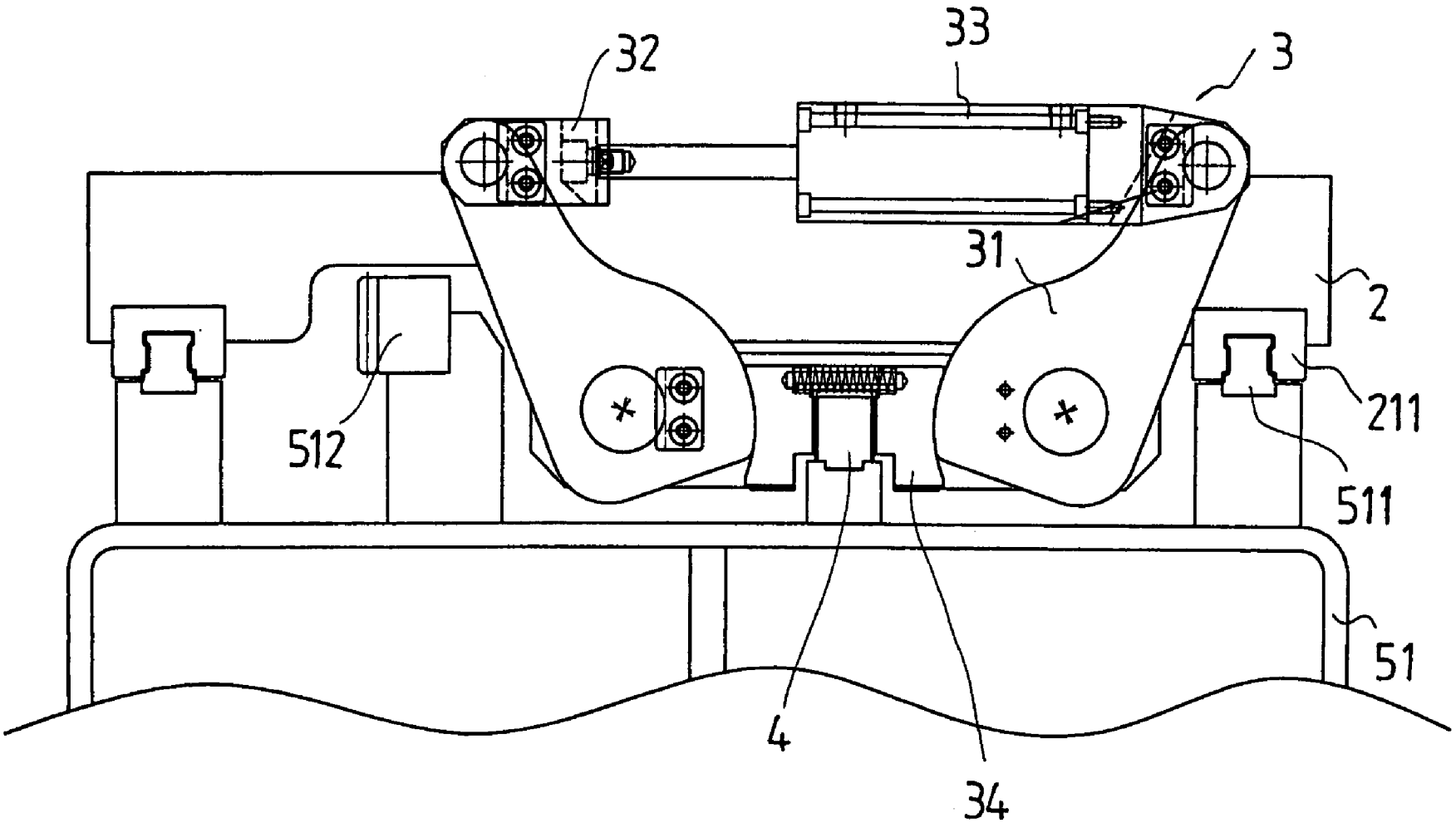
FIG. 8 is a view of the auxiliary fixing member, in a fixing position.
Figure 9:
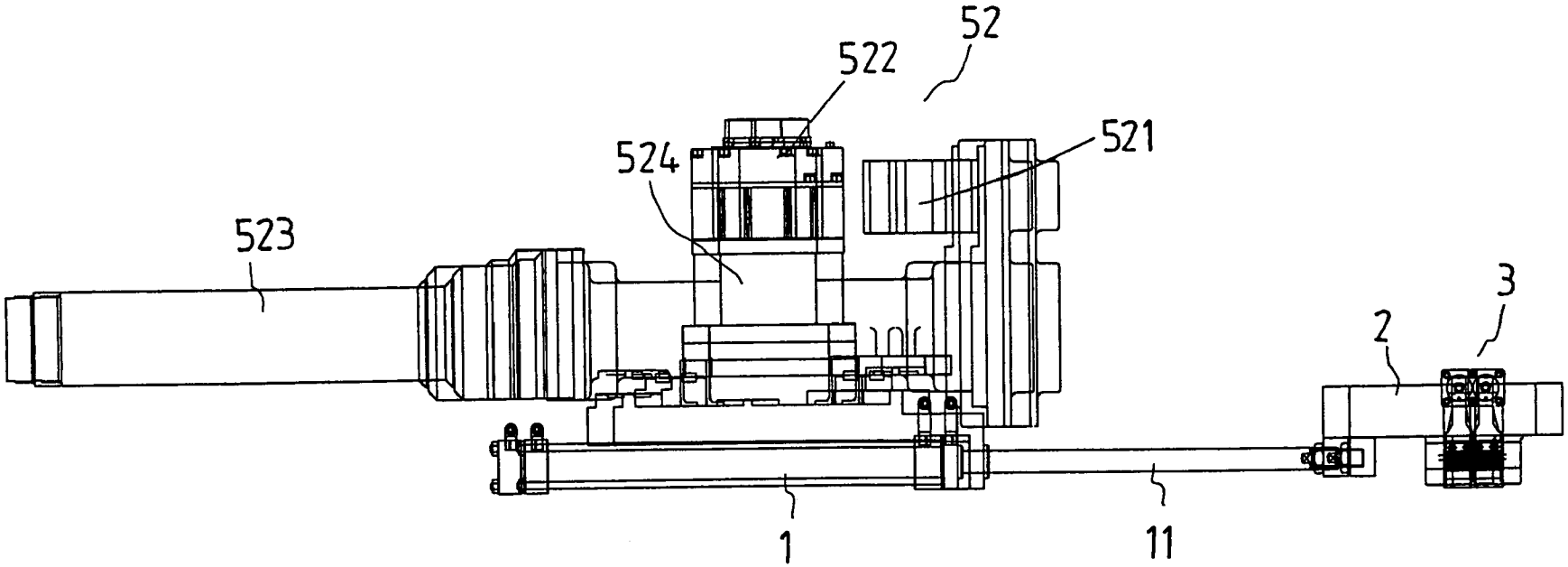
FIG. 9 is another view of the present feeding mechanism.
Figure 10:
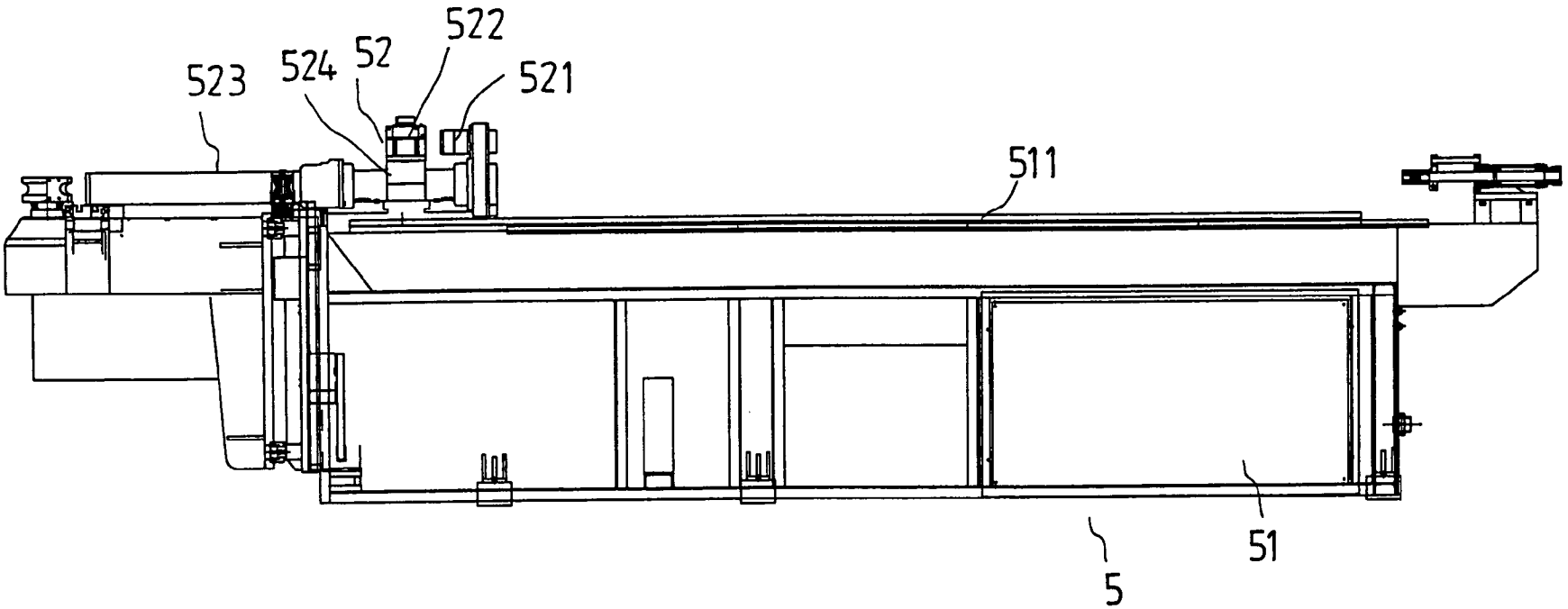
FIG. 10 (PRIOR ART)
FIG. 10 is a front view of the conventional pipe bending machine.
Figure 11:
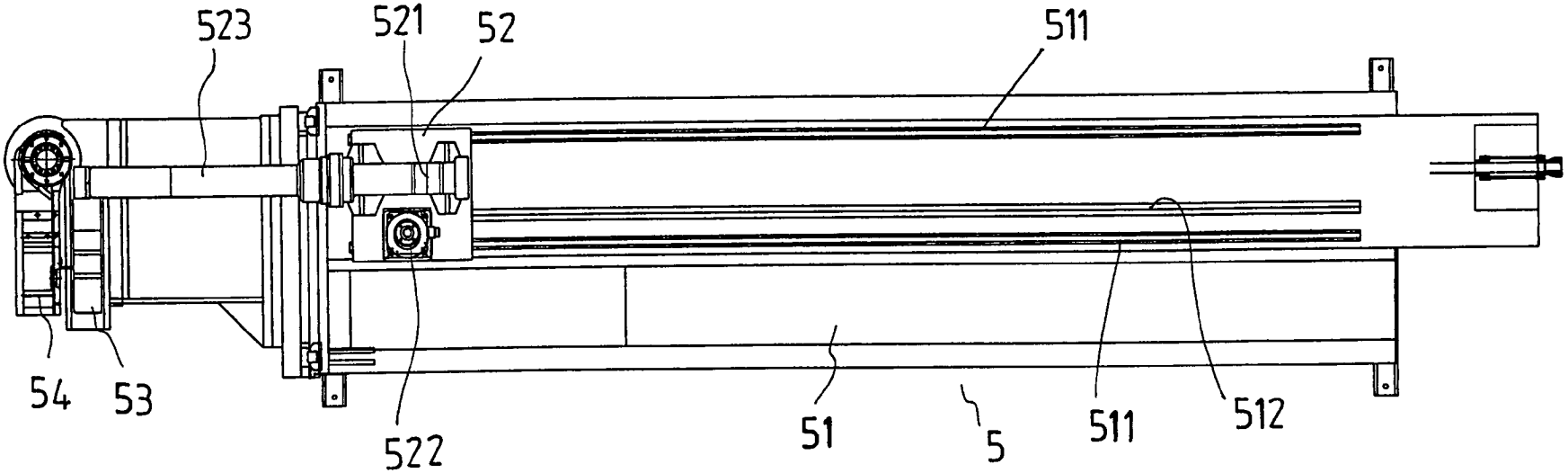
FIG. 11 (PRIOR ART)
FIG. 11 is a top view of the conventional pipe bending machine.
Figure 12:
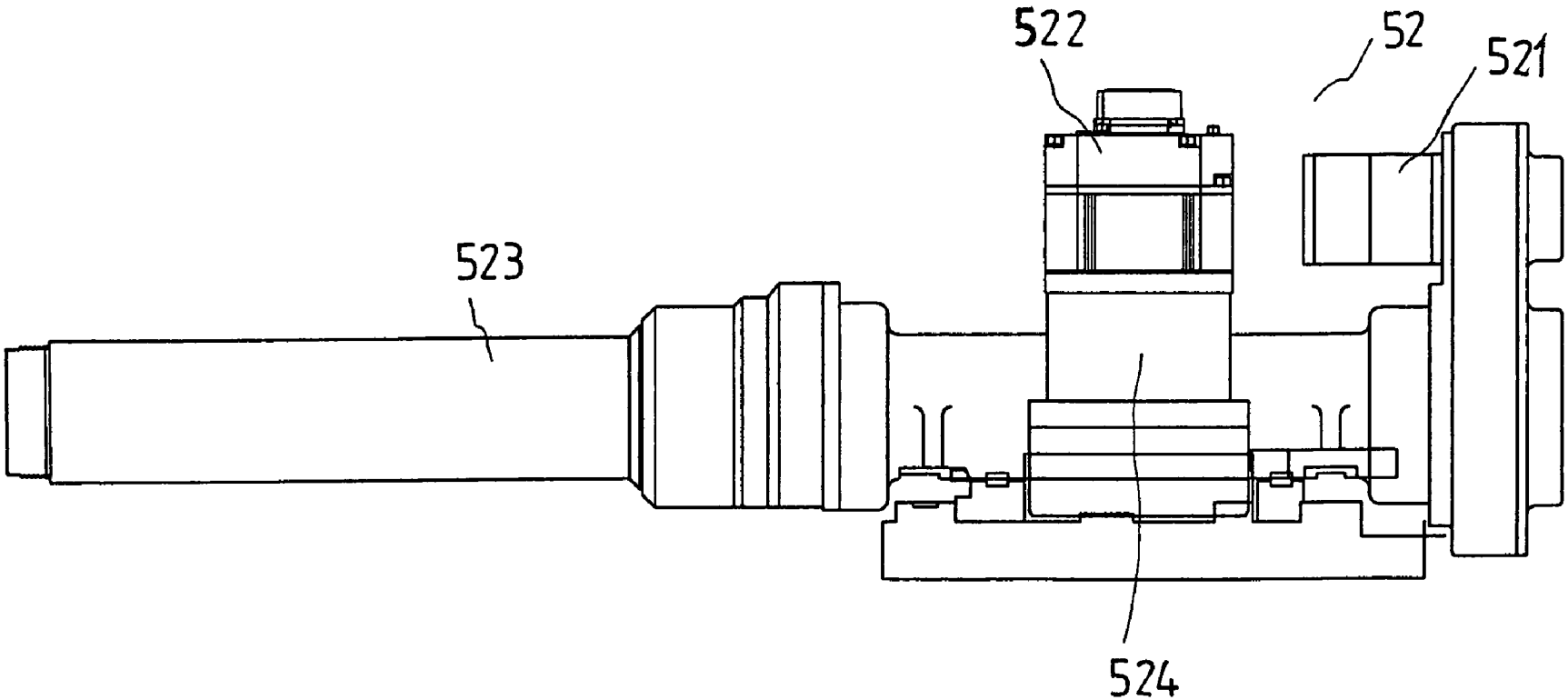
FIG. 12 (PRIOR ART)
FIG. 12 is a view of the feeding mechanism of the conventional pipe bending machine.
Figure 13:
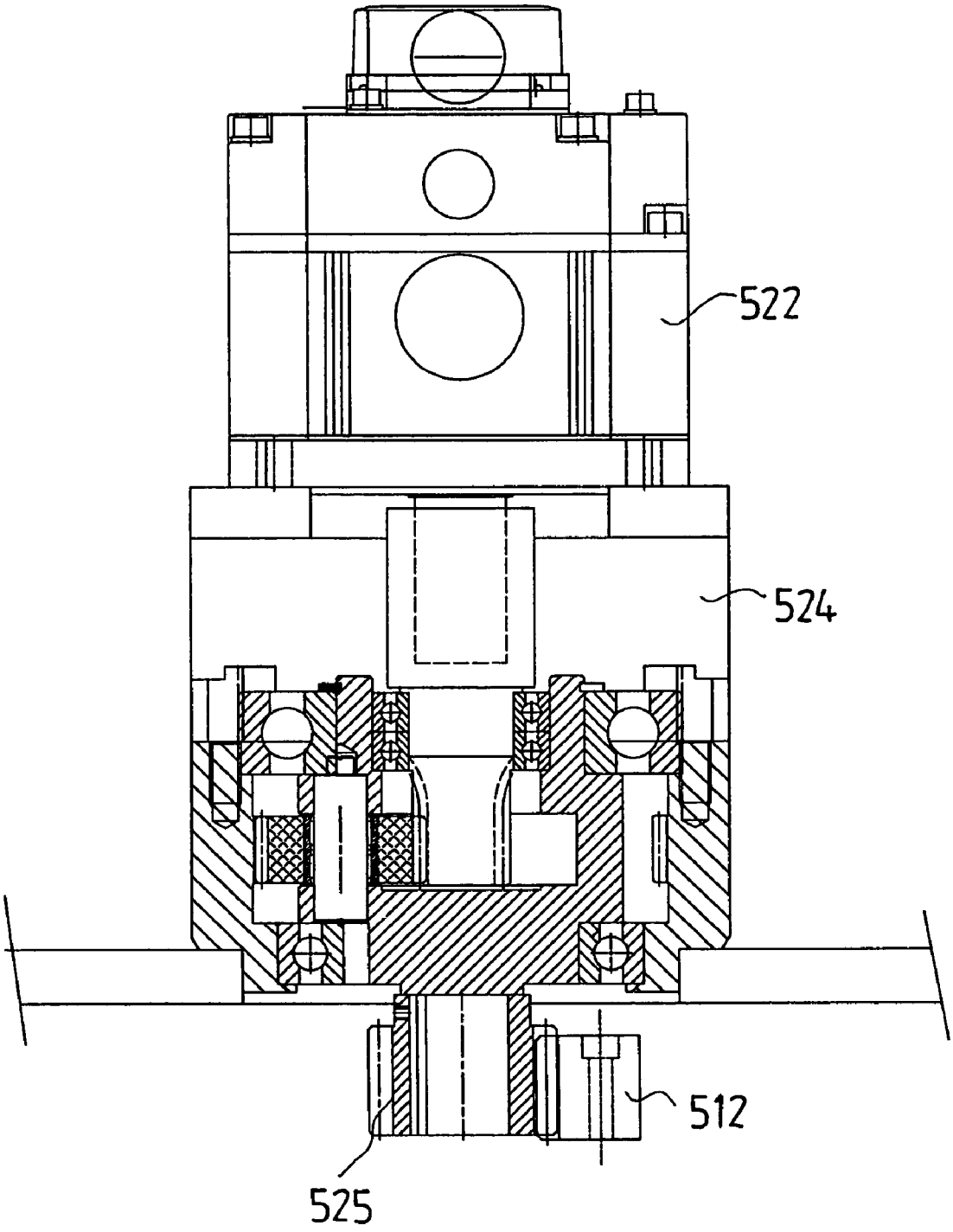
F I G. 13 (PRIOR ART)
FIG. 13 is a vertical section of the conventional feeding mechanism.

Referring to FIG. 9 in the present invention, a preferred embodiment of a feeding mechanism of an automatic pipe bending machine has a main part, which includes a first power source 521, a second power source 522, a holding tube 523, and a transmission 524. The feeding mechanism is further equipped with an auxiliary power source 1, and an auxiliary fixing member 2, as shown in FIGS. 1 to 8. Furthermore, a gear (not numbered) is secured to an output shaft of the transmission 524.

Two guide rails 511 and rack 512 parallel to the guide rails 511 are securely disposed on a main body 51 of the pipe bending machine. And, a locating rod 4, which has engaging teeth 41 spaced along two lateral sides thereof, is securely disposed on the main body 51 of the machine. The feeding mechanism 52 is displaceable along the main body 51 of the bending machine while the gear of the transmission 524 is engaged with the rack 512. The holding tube 523 is provided for securing a pipe thereto, and is connected to the first power source 521 to be rotary when the first power source 521 operates. The transmission 524 is connected to the second power source 522 such that the gear will be rotated, and the whole feeding mechanism will be moved along the main body 51 when the second power source 522 operates.

Figure 1:
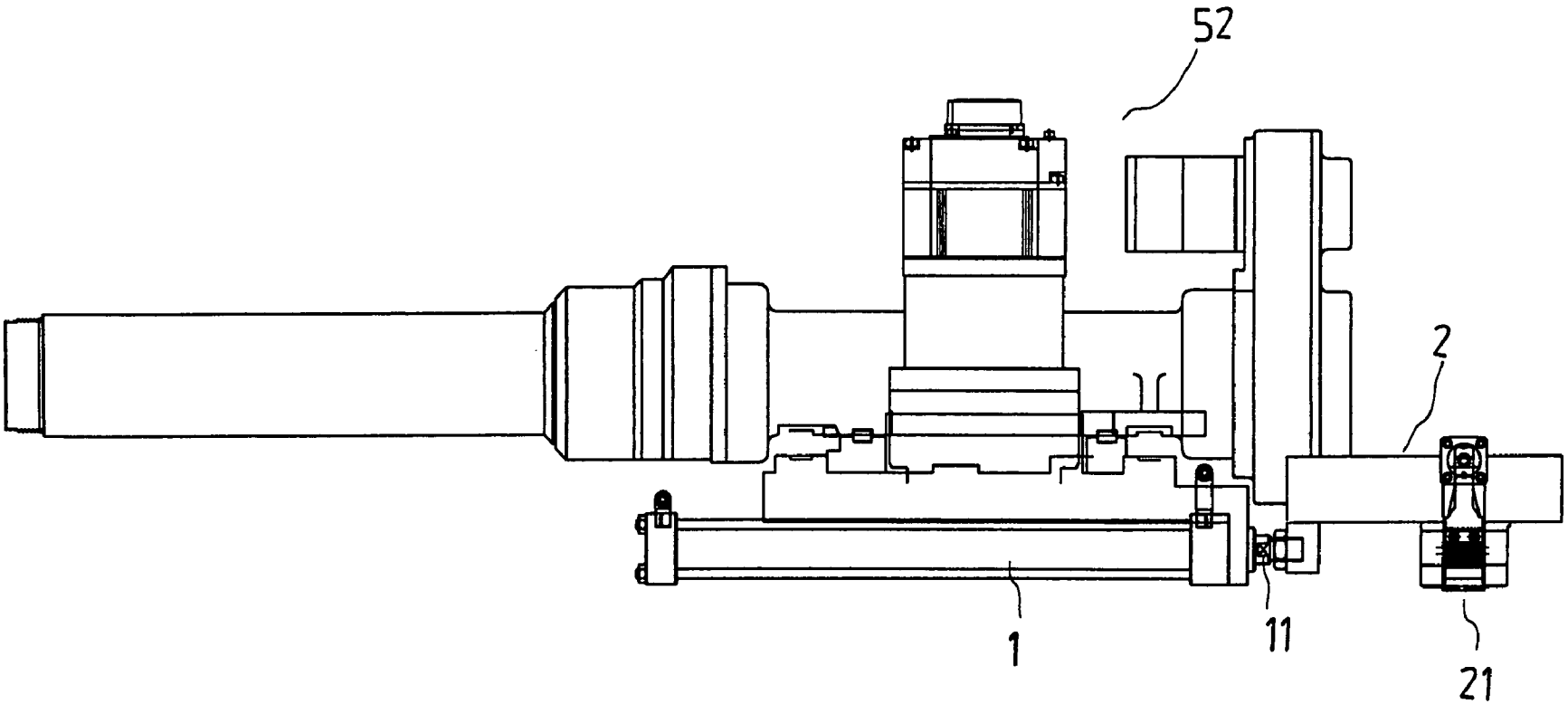
FIG. 1 is a view showing the structure of the feeding mechanism of an automatic pipe bending machine in the present invention.
Figure 3:
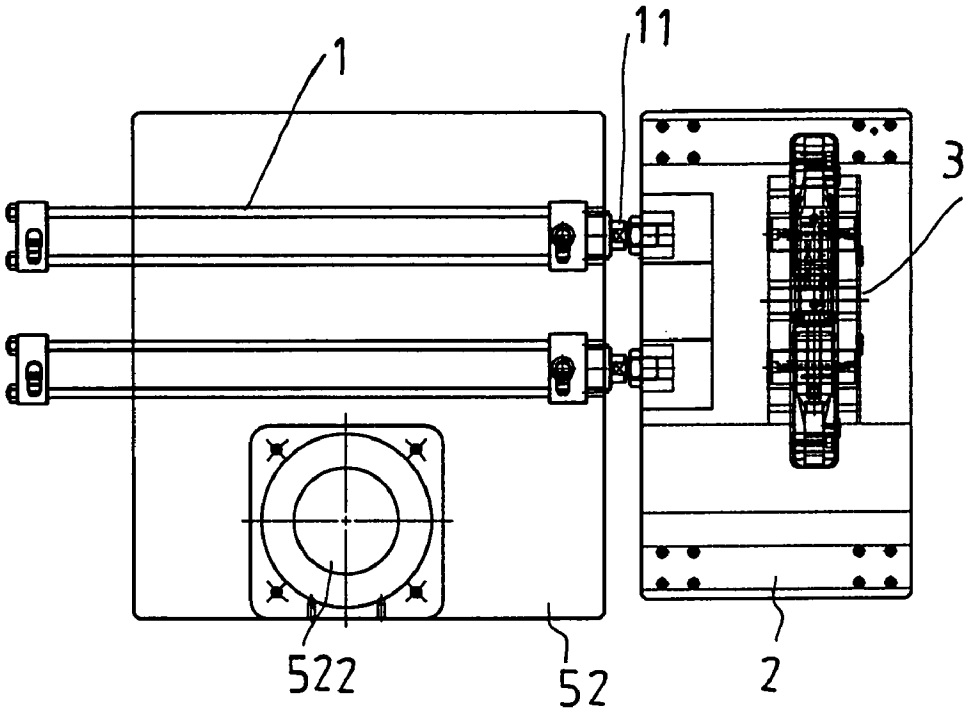
FIG. 3 is a top view of the present feeding mechanism.
Figure 2:
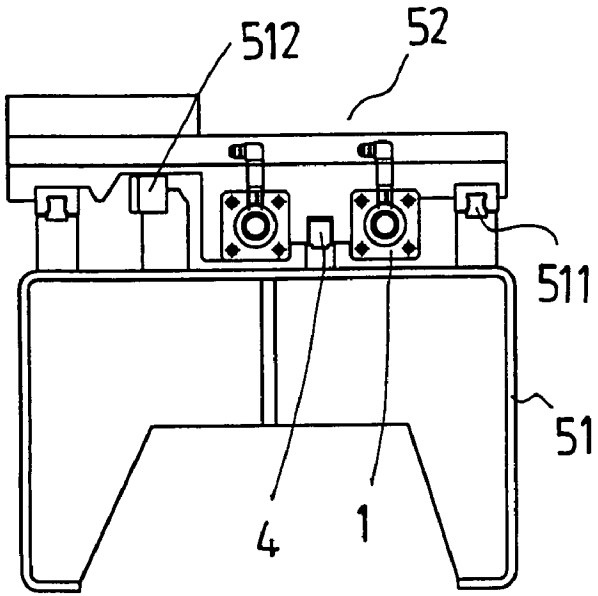
FIG. 2 is a first partial view of the feeding mechanism of the present invention.
Figure 4:
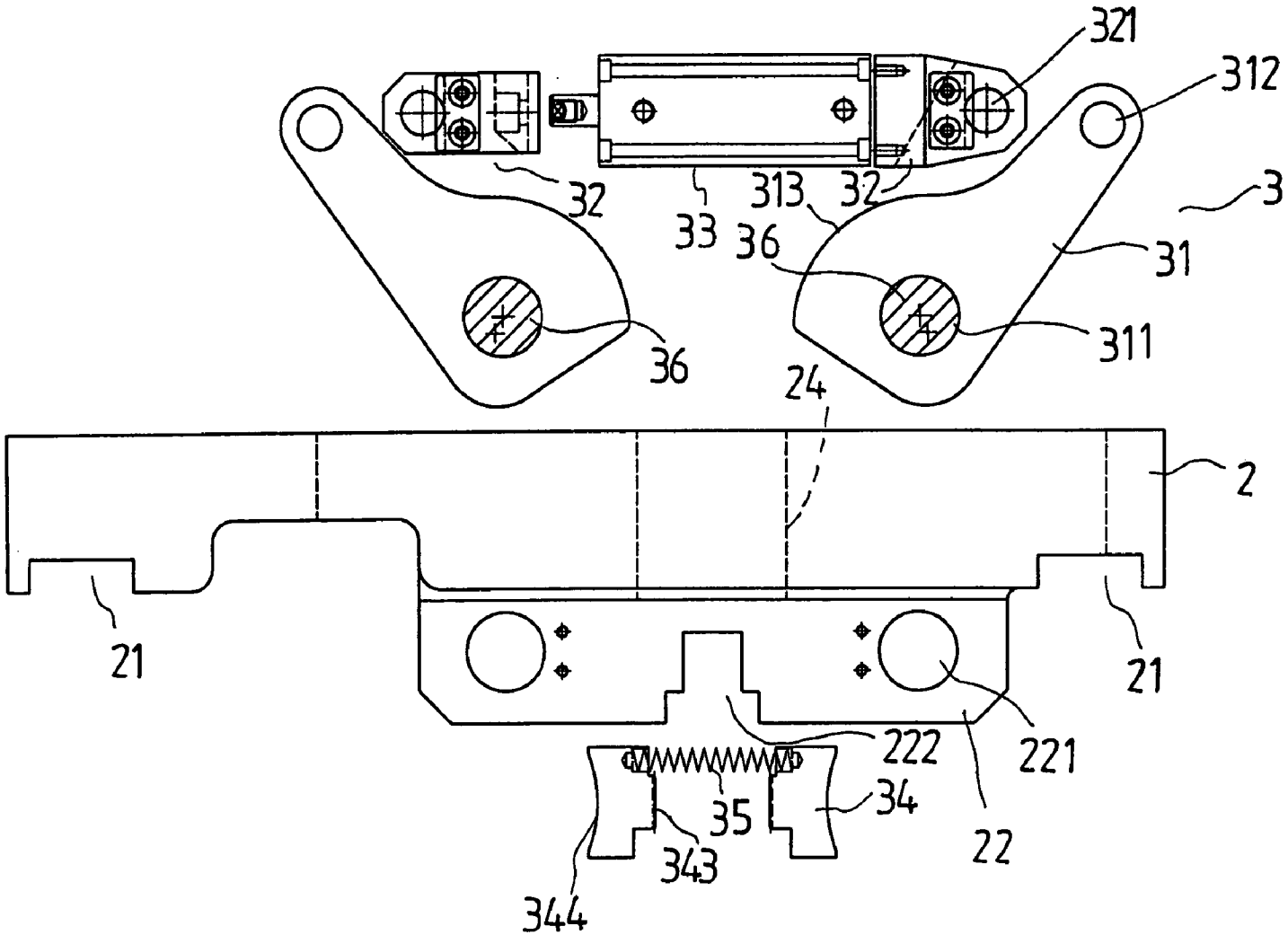
FIG. 4 is a first partial exploded view of the feeding mechanism of the invention.
Figure 5:
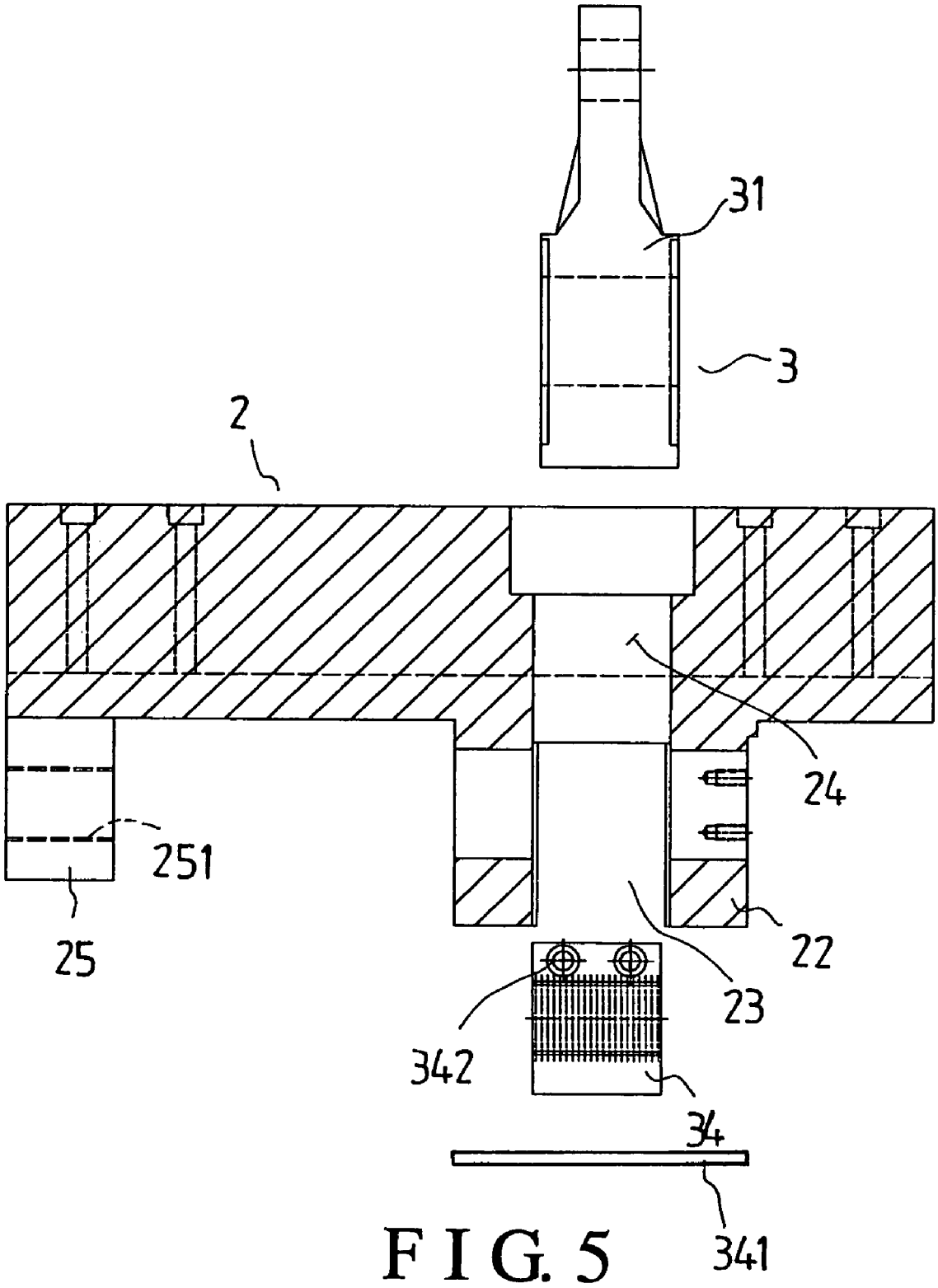
FIG. 5 is a second partial exploded view of the feeding mechanism of the invention.
Figure 6:
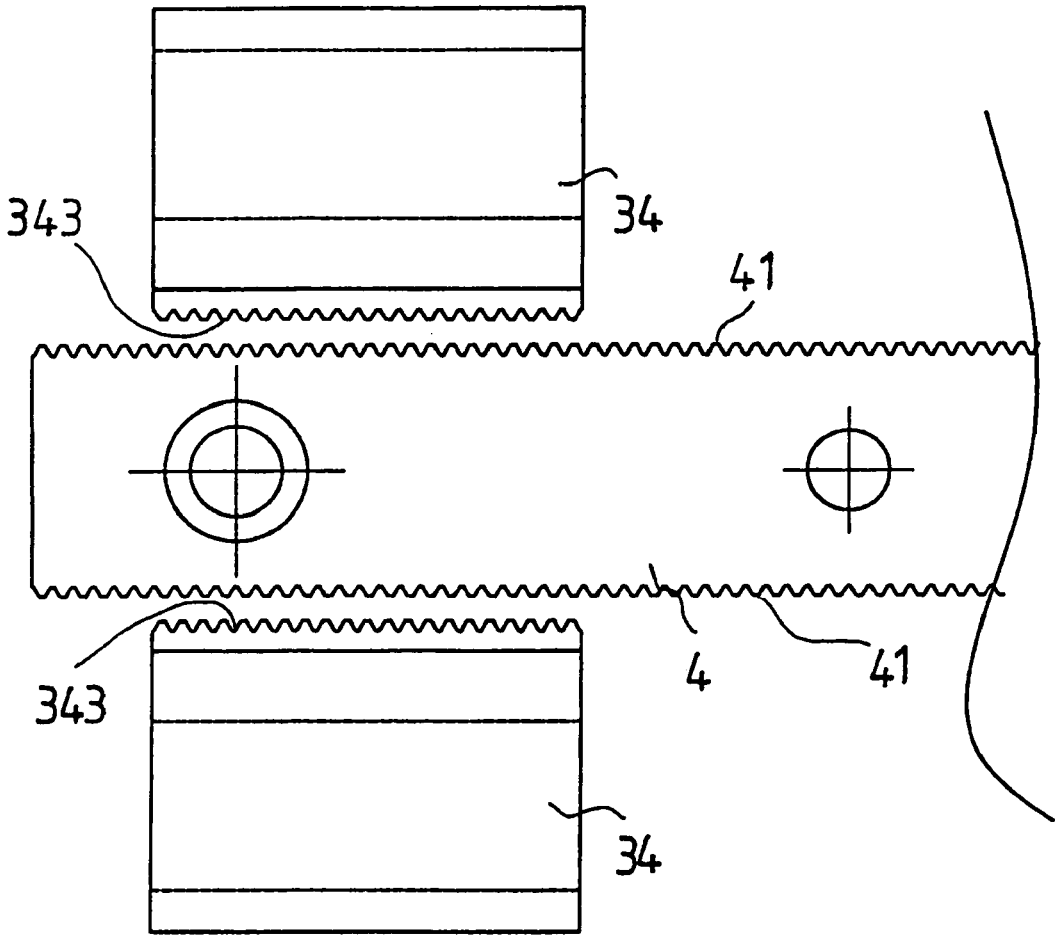
FIG. 6 is a third partial exploded view of the feeding mechanism of the present invention.

Referring to FIGS. 1 to 3, the auxiliary power source 1 includes two parallel hydraulic cylinders 11, and is securely joined to a lower side of the main part of the feeding mechanism.

The auxiliary fixing member 2 is joined to output rods 11 of the hydraulic cylinders of the auxiliary power source 1. The auxiliary fixing member 2 has two cavities 21 on lower side of two ends, two sliding blocks 211 respectively secured in the cavities 21, two downwards extending parallel board portions 22, a holding space 23 between the parallel board portions 22, and two holding through holes 24 right above and communicating with the holding space 23. The auxiliary fixing member 2 is further formed with a fitting projection 25 having a plurality of fitting holes 251, and the output rods 11 of the power source 1 are joined to the fitting holes 251. Each of the board portions 22 is formed with two pivotal holes 221, and a gap 222 between the pivotal holes 221. Pivotal holes 221 of one of the board portions 22 are respectively opposed with those of the other board portion 22 while the gaps 222 are faced with each other. The sliding blocks 211 are respectively fitted over the guide rails 511, and the board portions 22 are fitted onto the toothed locating rod 4 at the gaps 222 such that the auxiliary fixing member 2 can only move along the guide rails 511.

Furthermore, the auxiliary fixing member 2 is equipped with an engaging device 3, which consists of a pair of pushing bars 31, two pivotal blocks 32, a power source 33, and a pair of engaging blocks 34. Each of the pushing bars 31 has pivotal holes 311 and 312 respectively formed on lower and upper ends thereof, and an eccentric convexly curve portion 313 at the lower portion. The power source 33 can be a combination of two hydraulic cylinders, and the pivotal blocks 321 are respectively connected to two ends of the power source 33 such that they can be moved further away from and closer to each other by means of the power source 33. The pushing bars 31 are passed through respective ones of the holding through holes 24, and are pivoted to the parallel board portions 22 at the lower pivotal holes 311 thereof by means of pivotal shafts 36, which are passed through the pivotal holes 221 of the board portions 221 as well as the pivotal holes 311, such that the eccentric convexly curve portions 313 face each other. The pushing bars 31 are further pivoted to respective ones of the pivotal blocks 32 at the upper pivotal holes 312 thereof with pivotal shafts 321; thus, the eccentric convexly curve portions 313 can be moved further away from and closer to each other with the help of the power source 33.

Each of the engaging blocks 34 has several fitting cavities 342, a concavely curved portion 344 on an outward side, and an engaging portion 343 on an inward side, which has engaging teeth (not numbered) thereon for engagement with the engaging teeth 41 of the locating rod 4. The engaging blocks 34 are arranged within the holding space 23 and on two sides of the toothed locating rod 4 with the engaging portions 343 facing each other, and with the concavely curved portions 344 being adjacent to respective ones of the eccentric convexly curve portions 313 of the pushing bars 31. In addition, springs 35 are fitted into the fitting cavities 342 at two ends to bias the engaging blocks 34 away from each other at such a distance that the engaging blocks 34 disengage the toothed locating rod 4. A supporting plate 341 is secured to the lower ends of the board portions 22 to support the engaging blocks 34 thereon. Thus, the eccentric convexly curve portions 313 will make the engaging blocks 34 move closer to each other when the power source 33, i.e. the hydraulic cylinders, operates to project the output rods thereof. Consequently, the engaging blocks 34 engage the engaging teeth 41 of the locating rod 4, and the auxiliary fixing member 2 can't be displaced relative to the locating rod 4.

Figure 7:
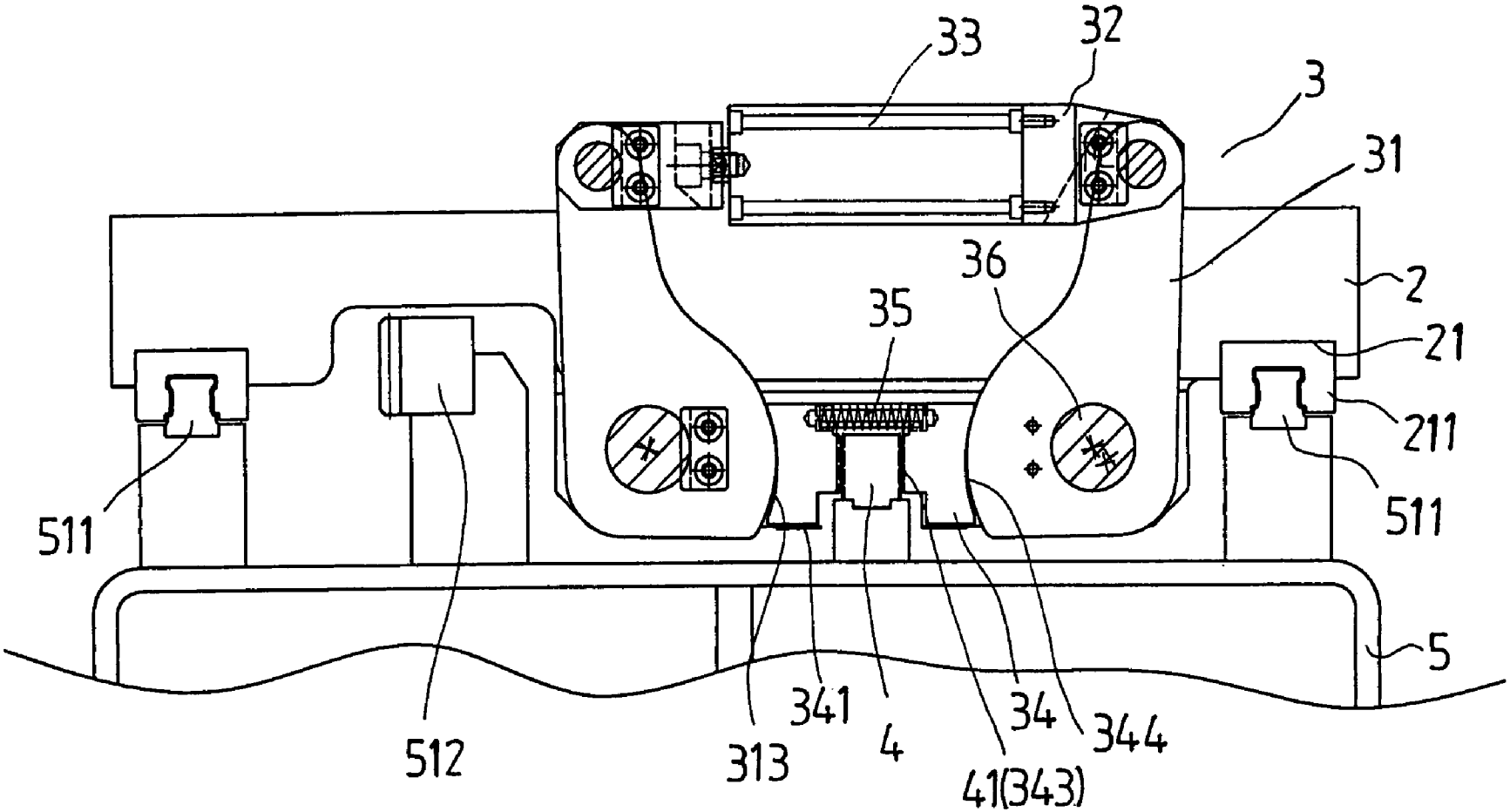
FIG. 7 is a view of the auxiliary fixing member of the feeding mechanism of the present invention.

In using the present bending machine, a pipe is first secured to the holding tube 523, and the upper ends of the pushing bars 31 are made to be closer to each other by means of the power source 33 such that the engaging blocks 34 are free to be biased away, and disengaged from the locating rod 4 by the springs 35, as shown in FIG. 7. Thus, the auxiliary fixing member 2, and the engaging device 3 can be moved closer to the main part of the feeding mechanism along the guide rails 511 when the auxiliary power source 1 operates with the output rods 11 thereof withdrawing. Then, the power sources 521 and 522 operate such that the pipe is rotated together with the holding tube, and such that the pipe, the auxiliary power source 1, the auxiliary fixing member 2, and the engaging device 3 are moved towards a bending mechanism (not shown) together with the main part of the feeding mechanism. After the main part of the feeding mechanism is moved to an intended position, the power source 33 is actuated with output rods thereof being projected such that the upper ends of the pushing bars 31 are further away from each other, and the pushing bars 31 force the engaging blocks 34 to engage the toothed locating rod 4, as shown in FIG. 8. Then, the auxiliary power source 1 is actuated with the output rods 11 thereof being projected; thus, the auxiliary power source 1, which consists of several hydraulic cylinders, will provide additional pushing force to the main part of the feeding mechanism. Consequently, the pipe is fed into the bending mechanism by the sum of force outputs of both the power source 522 and the auxiliary power source 1, as shown in FIGS. 8 and 9.

From the above description, it can be easily understood that the feeding mechanism of a pipe bending machine in the present invention has the following advantages over the conventional one:

1. A pipe can be fed into the bending mechanism with the sum of force outputs of both the power source 522 and the auxiliary power source 1 when the engaging blocks 34 engage the toothed locating rod 4. Therefore, pipes can be fed more smoothly.
2. When the auxiliary power source 1 operates to feed a pipe together with the power source 522, total pushing force output of the feeding mechanism is increased, and only partly exerted on the original transmission 524 and the original rack 512 and partly exerted on the engaging blocks 34 as well as the toothed locating rod 4. Consequently, the transmission 524 and the rack 512 won't be subjected too much force, and service life thereof can be longer.

What is claimed is:

1. An improvement on a feeding mechanism of an automatic pipe bending machine, comprising a main part for securing a pipe thereto; the main part being displaceable along a plurality of guide rails secured on a main body of the bending machine;

a first power source fitted to the main part;

a transmission connected to the first power source such that a gear thereof will rotate when the first power source operates;

a rack securely disposed on the main body of the bending machine; the gear of the transmission being engaged with the rack such that the main part will be displaced along the guide rails when the first power source operates;

a second power source fitted to the main part; the second power source having a plurality of output rods;

a plurality of second parallel guide rails secured on the main body of the bending machine;

an auxiliary fixing member joined to the output rods of the second power source and displaceable along the second guide rails;

a locating rod secured on the machine main body; the locating rod having engaging teeth formed along two lateral sides thereof;

an engaging device fitted to the fixing member for releaseably engaging the toothed locating rod to fix the fixing member to the locating rod; the engaging device including:

(1) a pair of pushing bars pivoted to the fixing member at lower end portions; the lower end portions of the pushing bars having eccentric convexly curved portions facing each other;

(2) a third power source connected to upper end portions of the pushing bars for changing distance between the eccentric convexly curved portions of the pushing bars with; and (3) a pair of engaging blocks movably arranged between the eccentric convexly curved portions of the pushing bars and on two sides of the toothed locating rod; the engaging blocks having engaging teeth facing the engaging teeth of the locating rod; the engaging blocks being capable of engaging the locating rod when the pushing bars are moved such that the convexly curved portions thereof press the engaging blocks against the locating rod; the engaging blocks being capable of disengaging the locating rod when the pushing bars are moved such that the convexly curved portions are away from the engaging blocks;

thereby being capable of being displaced by means of the second power source in addition to the first power source when the engaging blocks engage the locating rod, and when the second power source operates.

2. The feeding mechanism as claimed in claim 1, wherein each of the second and the third power sources is a hydraulic cylinder.

3. The feeding mechanism as claimed in claim 1, wherein the second power source is a combination of two hydraulic cylinders.

4. The feeding mechanism as claimed in claim 1, wherein the auxiliary fixing member has:

two cavities thereon;

slide blocks fitted in respective ones of the cavities and fitted on respective ones of the second guide rails; and a fitting projection thereon; the fitting projection having a plurality of fitting holes; the output rods of the second power source being respectively joined to the fitting holes.

5. The feeding mechanism as claimed in claim 4, wherein the auxiliary fixing member has two downwards extending parallel board portions with a holding space provided in between for holding the engaging blocks of the engaging device therein, and the third power source includes a plurality of hydraulic cylinders, and the engaging device further has:

(1) two pivotal blocks connected to respective ends of the third power source;

(2) a plurality of springs each fitted to cavities of inward sides of the engaging blocks at two ends for biasing the engaging blocks away from the engaging teeth of the locating rod; the engaging blocks having concavely curve portions facing respective ones of the eccentric convexly curve portions of the pushing bars; and (3) a supporting plate joined to lower ends of the down extending board portions of the fixing member to support the engaging blocks thereon;

each of the board portions being formed with two pivotal holes, and a gap between the pivotal holes thereof; the board portions being fitted onto the toothed locating rod at the gaps thereof;

two holding through holes right above and communicating with the holding space;

the pushing bars of the engaging device being respectively passed through the holding through holes of the fixing member, and pivoted to the pivotal holes of the down extending board portions at the lower end portions; the pushing bars being respectively pivoted to the pivotal blocks at the upper end portions such that the third power source can change distance between the eccentric convexly curve portions of the pushing bars when being in operation.

* * * * *